US011084242B2

(12) United States Patent
Haug

(10) Patent No.: US 11,084,242 B2
(45) Date of Patent: Aug. 10, 2021

(54) METHOD FOR THREE-DIMENSIONAL SHAPING OF MATERIAL

(71) Applicant: Pester Pac Automation GmbH, Wolfertschwenden (DE)

(72) Inventor: Hans Haug, Bad Groenenbach (DE)

(73) Assignee: Pester Pac Automation GmbH, Wolfertschwenden (DE)

( * ) Notice: Subject to any disclaimer, the term of this patent is extended or adjusted under 35 U.S.C. 154(b) by 228 days.

(21) Appl. No.: 15/759,320

(22) PCT Filed: Sep. 4, 2016

(86) PCT No.: PCT/EP2016/070789
§ 371 (c)(1),
(2) Date: May 18, 2018

(87) PCT Pub. No.: WO2017/042108
PCT Pub. Date: Mar. 16, 2017

(65) Prior Publication Data

US 2018/0264768 A1 Sep. 20, 2018

(30) Foreign Application Priority Data

Sep. 10, 2015 (DE) ..... 10 2015 115 251.7

(51) Int. Cl.
*B31D 5/02* (2017.01)
*B31B 50/59* (2017.01)
(Continued)

(52) U.S. Cl.
CPC ..... *B31D 5/02* (2013.01); *B31B 50/592* (2018.05); *B31F 1/008* (2013.01); *B31F 1/0077* (2013.01);
(Continued)

(58) Field of Classification Search
CPC ..... B31D 5/02; B31B 50/592; B31F 1/0077; B31F 1/008; B31F 1/0087; B31F 1/36; B65B 47/06
See application file for complete search history.

(56) References Cited

U.S. PATENT DOCUMENTS 444,916 A * 1/1891 Ferguson ..... B31D 5/02 162/403
954,962 A * 4/1910 Homburg ..... B31D 5/02 162/403
(Continued)

FOREIGN PATENT DOCUMENTS

DE 102010037092 A1 * 2/2012 ..... B65D 85/505
DE 10 2013 107 932 A1 1/2015
(Continued)

OTHER PUBLICATIONS

International Search Report of PCT/EP2016/070789, dated Feb. 23, 2017.

*Primary Examiner* — Nathaniel C Chukwurah
*Assistant Examiner* — Lucas E. A. Palmer
(74) *Attorney, Agent, or Firm* — Collard & Roe, P.C.

(57) ABSTRACT

A method for the three-dimensional shaping of flat material made from in particular, natural fibers, such as for example, paper or cardboard, using a deep-drawing piston and a die, through which or into which the material is drawn. The diameter of the deep-drawing piston plus the material thickness of the deep-drawn material corresponds at least approximately to the diameter of the die.

14 Claims, 2 Drawing Sheets

Figure 1:
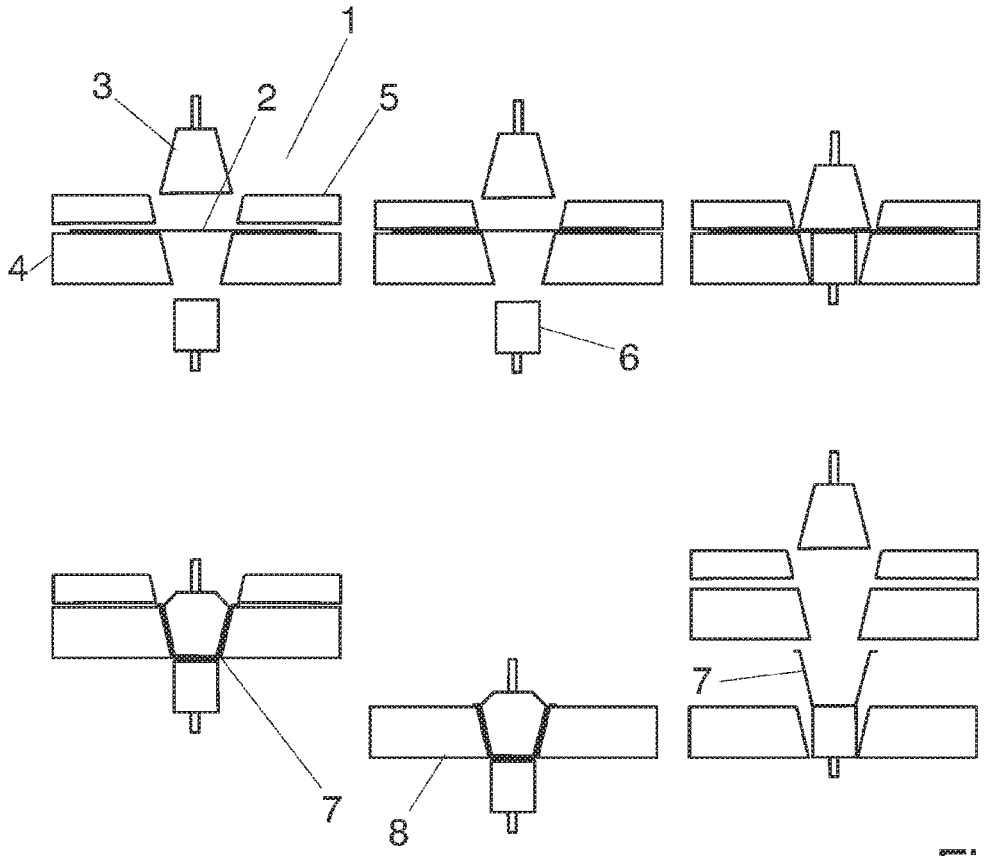

(51) Int. Cl.
*B31F 1/00* (2006.01)
*B31F 1/36* (2006.01)
*B65B 47/06* (2006.01)

(52) U.S. Cl.
CPC ..... *B31F 1/0087* (2013.01); *B31F 1/36* (2013.01); *B65B 47/06* (2013.01)

(56) References Cited

U.S. PATENT DOCUMENTS 958,019 A * 5/1910 Shackleton ..... B31D 5/02 162/403
1,660,411 A * 2/1928 Bodor ..... B31D 5/02 425/399
2,131,438 A * 9/1938 Jensen ..... B65D 41/62 215/326
2,270,187 A * 1/1942 Dulmage ..... B29C 51/08 425/161
2,272,920 A * 2/1942 Merta ..... B29C 51/26 493/158
2,278,299 A * 3/1942 Barbieri ..... B31F 1/0087 264/299
2,354,564 A * 7/1944 Wiley ..... B31B 70/00 425/398
2,371,581 A * 3/1945 Goodwin ..... B31D 5/02 493/152
2,381,851 A * 8/1945 Allen ..... B31D 5/02 493/85
2,703,042 A * 3/1955 Goodwin ..... B31F 1/0038 493/160
2,892,749 A * 6/1959 Carpenter ..... B31F 1/0038 156/194
3,058,160 A * 10/1962 Mocker ..... B31F 1/0009 264/292
3,695,084 A * 10/1972 Siemonsen ..... B21D 51/10 72/348
4,101,627 A * 7/1978 Menier ..... B31D 5/02 264/163
4,191,322 A * 3/1980 Kinney ..... B65D 3/12 229/5.8
4,576,566 A * 3/1986 Hain ..... B31F 1/0077 425/400
4,686,076 A * 8/1987 Dromigny ..... B29C 33/123 264/268
4,773,182 A * 9/1988 Weder ..... A01G 5/04 47/72
4,897,031 A * 1/1990 Weder ..... A01G 5/04 425/388
5,173,314 A * 12/1992 Hosoi ..... B29C 51/004 100/211
5,209,099 A * 5/1993 Saunders ..... B21D 22/201 72/349
5,551,140 A * 9/1996 Weder ..... A01G 5/04 29/450
6,146,122 A * 11/2000 Kato ..... B29C 43/203 264/257
2004/0232595 A1* 11/2004 Bartoli ..... B29C 51/28 264/289.3
2013/0092312 A1* 4/2013 Cassoni ..... B31B 50/592 156/69
2013/0263559 A1* 10/2013 Scolaro ..... B29C 66/8412 53/485
2014/0255630 A1* 9/2014 Kunihiro ..... B65D 1/265 428/34.2
2017/0057678 A1* 3/2017 Hauptmann ..... B65B 47/04
2018/0319116 A1* 11/2018 Haug ..... B31D 5/02

FOREIGN PATENT DOCUMENTS

DE 102013107932 A1 * 1/2015 ..... B31B 50/592
EP 2829392 A1 * 1/2015 ..... B31B 50/592

* cited by examiner

METHOD FOR THREE-DIMENSIONAL SHAPING OF MATERIAL

CROSS REFERENCE TO RELATED APPLICATIONS

This application is the National Stage of PCT/EP2016/070789 filed on Sep. 4, 2016, which claims priority under 35 U.S.C. § 119 of German Application No. 10 2015 115 251.7 filed on Sep. 10, 2015, the disclosures of which are incorporated by reference. The international application under PCT article 21(2) was not published in English.

The invention relates to a method for three-dimensional shaping of flat material, in particular material composed of natural fibers, such as paper or cardboard, for example, using a piston and a sleeve-shaped counter-part, into which the material is drawn.

In such shaping methods, uncontrolled wrinkles of different sizes form, which can no longer be corrected afterward, but significantly impair the appearance of the finished object and possibly even its shape stability, strength, and tightness in the edge region.

The invention is based on the task of proposing a shaping method with which this uncontrolled wrinkle formation is prevented. Furthermore, a possibility is created of producing a complex final contour with an elevated shaping ratio in shape-stable and shape-holding manner.

This task is accomplished, according to the invention, in that the diameter of the deep-drawing piston plus the material thickness of the material to be deep-drawn corresponds at least approximately to the diameter of the die.

Because the diameter of the deep-drawing piston plus the material thickness of the material to be deep-drawn, in other words the diameter of the piston in cross-section, plus twice the material thickness, corresponds at least approximately to the diameter of the die at every point in time of the deep-drawing process, the wrinkles that occur in the material during deep-drawing are distributed uniformly and finely.

In this regard, it has proven to be very advantageous if the material is clamped in between the die and what is called a wrinkle holder, thereby allowing the material to slide along in targeted manner.

In this way, the deep-drawing result is improved once again. Among other things, the wrinkle distribution can be improved once again.

It is extremely advantageous, in this connection, if the wrinkle holder presses against the flat material with a variable pressure, wherein the wrinkle holder can press against the flat material under a spring load and/or the pressure of the wrinkle holder that acts against the flat material can be controlled or regulated.

As a result, sliding along of the material is determined and controlled precisely.

According to another embodiment of the invention, it is very advantageous if the diameter of the die can be changed.

By changing the diameter of the die, it is also possible to perform conical deep-drawing. In this regard, the diameter is not restricted solely to circular deep-drawing. Instead, all conceivable shapes are possible. This specifically includes circular, oval, polygonal, angular, etc.

In this regard, it has proven to be extremely advantageous if the die is composed of segments that can be moved relative to one another.

As a result, the diameter can be changed in simple manner.

Likewise, it is very advantageous, according to an embodiment of the invention, if the die is configured in sleeve shape, wherein a conical embodiment can be provided.

In this way, it is also possible to deep-draw conical shapes.

According to a further embodiment of the invention, it is very advantageous if the deep-drawing piston is configured to be conical.

In combination with a die that can be changed in diameter, the drawing gap can thereby always be kept constant.

A further very advantageous embodiment of the invention is also present if the deep-drawing piston can be changed with regard to its diameter, wherein segments can be provided, which can be moved relative to one another.

A deep-drawing piston having a changeable diameter can be used very well with a conical die. A possibility for changeability of the diameter of the deep-drawing piston is a structure composed of segments that can be adjusted relative to one another.

It is also extremely advantageous, according to the invention, if the deep-drawing piston can be changed, in terms of its shape and/or its dimensions by means of internal pressure, wherein the pressure can be built up by means of compressed air or a hydraulic medium.

In this way, the drawing gap is also kept constant. Such a deep-drawing piston can be used both with a conical die and with a die that can be changed in diameter.

According to the invention, it has also proven to be very advantageous if a counter-punch to the deep-drawing piston is provided in the axial direction, which punch presses the material against the deep-drawing piston during shaping, wherein the counter-punch can be configured to be variable and regulatable.

As a result, the material is reliably guided during shaping, so that no uncontrolled movements of the material can occur. The holding force can be adjusted very precisely.

Furthermore, it is very advantageous if, according to the invention, a calibration device is provided, in which the shaped material is pressed against the piston.

As a result, small wrinkles that occur during shaping can be equalized in simple manner.

It has also proven to be very advantageous if, according to a further embodiment of the invention, the material is moistened, at least on one side, before, during and/or after shaping and/or calibration.

By means of this moistening, the shaping ability and calibration ability of the material is very significantly improved.

According to an advantageous further development of the invention, it is provided that the material is heated before, during and/or after shaping and/or before and/or during calibration.

In this way, as well, the shaping ability and calibration ability of the material is significantly increased.

In this regard, it has proven to be very advantageous if, according to a further embodiment of the invention, the temperature and/or the processing moisture of the material is selected or adjusted as a function of the material used.

A further advantageous embodiment of the invention lies in that the material has been provided or is provided with a plastic layer, at least on one side.

In this way, the material that contains fiber is effectively protected against internal and/or external influences.

It is also very advantageous if, according to a further embodiment of the invention, the finely distributed wrinkles that form during shaping are pressed flat.

In this way, a very smooth surface of the shaped part can be achieved.

It is also very advantageous if, according to a further embodiment of the invention, the open end is folded over to form a sealing edge.

In this way, the container that is created can be closed in simple manner after having been filled.

It is also extremely advantageous, according to the invention, if the sealing edge is additionally compressed, wherein the compression can take place while supplying heat and/or after previous moistening.

As a result, a very smooth and uniform sealing edge is created, which also has good strength properties.

However, other configurations of the open end are also conceivable; for example, the formation of what is called a lip is possible.

In the drawing, the invention is illustrated using an exemplary embodiment.

Figure 2:
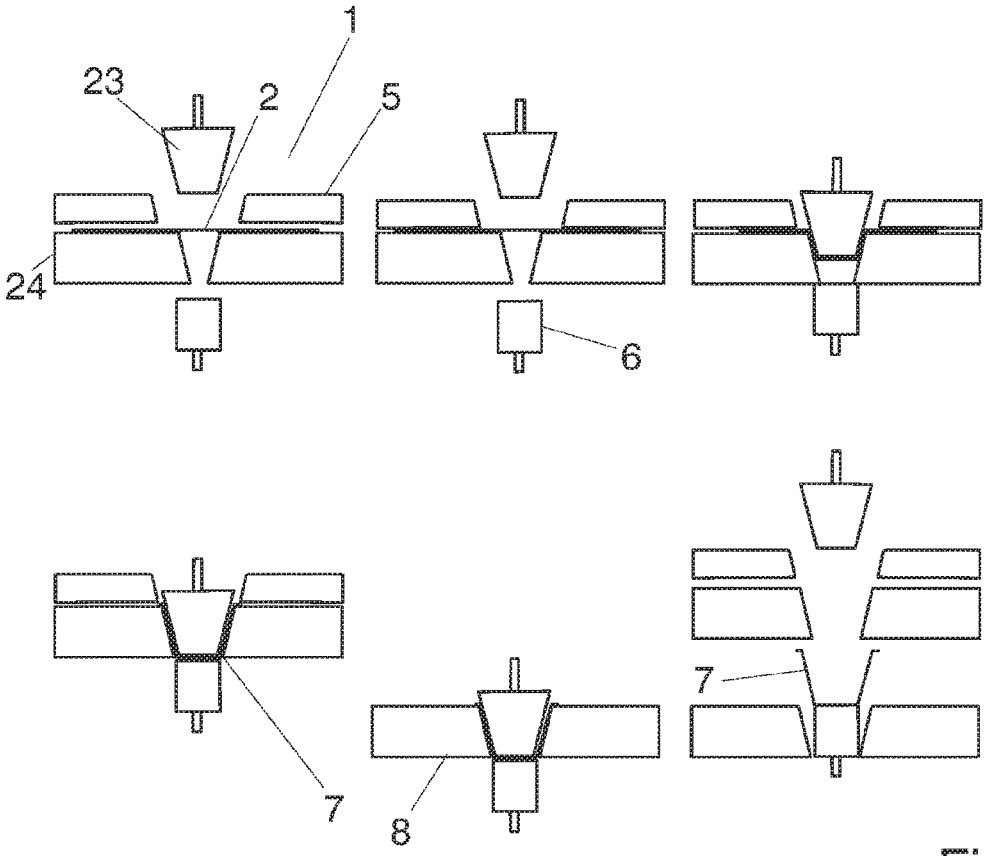

In this regard, the figures show:

FIG. 1 a schematic representation of the sequence of the method according to the invention, using a conical die, and FIG. 2 a schematic representation of the sequence of the method according to the invention, using a changeable die.

1 refers to an apparatus with which paper or cardboard or material 2 that contains fiber can be shaped from a flat state into a cup-shaped or shell-shaped state.

The apparatus 1 has a piston 3, as well as a die 4 that is configured in conical sleeve shape in this exemplary embodiment, and acts as a counter-part to the piston 3. The material 2 is pressed into the die 4 by the piston 3. In this regard, the material 2 is pressed against the top of the die 4 by a wrinkle holder 5, so that is can slide along only in controlled manner as it enters the die 4.

The piston 3 is configured to be changeable. Either it is composed of segments, so that the respective diameter of the piston 3 can be changed by displacing the segments relative to one another, or, alternatively, the piston 3 can be changed with regard to size and/or shape by applying compressed air or a hydraulic medium.

Other embodiments of the piston 3 are conceivable.

It is essential that the diameter of the piston 3 corresponds at least approximately to the respective diameter of the die 4 minus twice the thickness of the material 2 at every point in time, so that the piston 3, the material 2, and the die 4 lie tightly against one another. At most a small gap should be formed. However, it is also conceivable that the piston 3 presses the material 2 slightly against the inner side of the die 4.

By means of a combination of these dimensions and the wrinkle holder 5, it is ensured that not only do just small and uniformly distributed wrinkles occur during deep-drawing of the material 2, but rather these are at least also equalized to a great extent. If the piston 3 is slightly smaller with reference to the die 4, it is also conceivable that the object 7 that is produced, the shaped part, is calibrated again after the shaping process, and the finely distributed wrinkles are pressed flat during this process.

The result is a smooth surface in the walls of the object that is deep-drawn from paper or cardboard.

An object having walls that run conically is directly formed by means of the conically configured die 4 and a piston 3 that is adapted to it.

As shown in the second exemplary embodiment, it is also conceivable that a conical piston 23 is provided, and the die 24 adapts its diameter to the respective position of the piston 23.

For this purpose, the die 24 can be composed of segments that can be moved relative to one another.

In this regard, the wrinkle holder can press against the flat material 2 under a spring load. However, it is also possible to provide a hydraulic, electromechanical or other pressing means, which is configured so that it can be controlled and/or regulated. A combination of a spring load and controlled or regulated hydraulics/pneumatics/actuators is also conceivable.

A counter-punch 6, which is disposed in the axial direction of the piston 3, presses against the material 2 from below, so that no material can flow out of the bottom region into the wall region that is to be shaped. However, it is possible that the material 2 is shaped in the bottom region between the piston 3 and the counter-punch 6 itself. In this connection, it is also conceivable that the stamping by means of the piston 3 and the counter-punch 6 takes place before the actual shaping process.

In this regard, piston 3 and counter-punch 6 can already close under the force of the wrinkle holder, and introduce the stamping. In this regard, a drawing process counter to the actual shaping using drawing is undertaken, and thereby the freedom of movement with regard to the degree of shaping and the configuration of the bottom is expanded.

It is also conceivable that after shaping, the part 7 that is formed is moved into a calibration device 8 by the piston 3, where the wall region is pressed against the piston 3 and during this process, the small and finely distributed wrinkles that were formed are equalized.

Furthermore, it is conceivable that the material is trimmed after shaping.

After calibration, the finished shaped part 7 is ejected by the counter-punch 6 after the piston 3 is moved upward.

It is also conceivable to pull the object 7 off using lifters or suction devices.

If the shaping process is carried out overhead, gravity can also ensure that the objects 7 that are produced fall out.

During this calibration, before or afterward, the upper wall region can be widened or an edge flange can be formed. This edge flange can be transformed either into a flat sealing edge or also into a lip.

To improve the shaping result, the material 2 can be moistened on one or both sides before shaping or also during this process. Heating is also possible, wherein a radiant heater for the material or a heater for the shaping tools is conceivable.

Coating, impregnation or other treatment of the material, for example with a plastic, is also possible to improve the tightness of the finished part 7, wherein this coating can be undertaken on the inside or outside or also on both sides.

Coating or treatment can also influence the deep-drawing process.

The invention claimed is:

1. A method for three-dimensional shaping of flat material using a deep-drawing piston and a die, comprising the step of pressing the flat material into the die by the deep-darwing piston, wherein the deep-drawing piston is comprised of segments that can be moved relative to each other, wherein the die is comprised of segments that can be moved relative to each other, wherein the diameter of the piston and/or the diameter of the die is changed by displacing the segments of the deep-drawing piston relative to each other and/or displacing the segments of the die relative to each other, wherein the deep-drawing piston is configured to be conical, and wherein a diameter of the deep-drawing piston plus a material thickness of the material to be deep-drawn corresponds at least approximately to a diameter of the die.

2. The method according to claim 1, wherein the material is clamped between the die and a wrinkle holder, thereby allowing the material to slide along in targeted manner during shaping.

3. The method according to claim 2, wherein the wrinkle holder presses against the flat material at a variable pressure, wherein the wrinkle holder can press against the flat material under a spring load and/or the pressure of the wrinkle holder that acts against the flat material can be controlled or regulated.

4. The method according to claim 1, wherein the die is configured in sleeve shape, wherein a conical embodiment can be provided.

5. The method according to claim 1, wherein the deep-drawing piston can be changed in terms of its shape and/or its dimensions, by means of internal pressure, wherein the pressure can be built up by means of compressed air or a hydraulic medium.

6. The method according to claim 1, wherein a counter-punch to the deep-drawing piston is provided in the axial direction, which punch presses the material against the deep-drawing piston during shaping, wherein the counter-punch can be configured to be variable and regulatable.

7. The method according to claim 1, wherein a calibration device is provided, in which the shaped material is pressed against the piston.

8. The method according to claim 1, wherein the material is moistened, at least on one side, before, during and/or after shaping and/or calibration.

9. The method according to claim 8, wherein the temperature and/or the processing moisture of the material is selected or adjusted as a function of the material used.

10. The method according to claim 1, wherein the material is heated before, during and/or after shaping and/or before and/or during calibration.

11. The method according to claim 1, wherein the material has been provided or is provided with a plastic layer, at least on one side.

12. The method according to claim 1, wherein the finely distributed wrinkles that form during shaping are pressed flat.

13. The method according to claim 1, wherein the open end is folded over to form a sealing edge.

14. The method according to claim 13, wherein the sealing edge is additionally compressed, wherein the compression can take place while supplying heat and/or after previous moistening.

* * * * *